United States Patent [19]

Bowman

[11] 4,356,462

[45] Oct. 26, 1982

[54] CIRCUIT FOR FREQUENCY SCAN ANTENNA ELEMENT

[75] Inventor: David F. Bowman, Moorestown, N.J.

[73] Assignee: RCA Corporation, New York, N.Y.

[21] Appl. No.: 208,425

[22] Filed: Nov. 19, 1980

[51] Int. Cl.[3] ..... H01P 5/12

[52] U.S. Cl. ..... 333/128; 333/136; 333/161; 343/854

[58] Field of Search ..... 333/109, 115, 116, 117, 333/123, 127, 128, 136; 343/854, 853

[56] References Cited

U.S. PATENT DOCUMENTS

| | | | |
|---|---|---|---|
| 3,091,743 | 5/1963 | Wilkinson . | |
| 3,255,450 | 6/1966 | Butler | 343/854 X |
| 3,525,995 | 8/1970 | Schroeder | 343/854 X |
| 3,710,281 | 1/1973 | Thomas . | |
| 3,742,392 | 6/1973 | Schwarzmann . | |
| 4,129,839 | 12/1978 | Galani et al. . | |
| 4,276,551 | 6/1981 | Williams et al. | 343/854 X |

OTHER PUBLICATIONS

Skolnik, Radar Handbook, McGraw-Hill, N.Y., 1970, pp. 13-9 through 13-16.

*Primary Examiner*—Paul L. Gensler
*Attorney, Agent, or Firm*—Samuel Cohen; Robert L. Troike; Christopher L. Maginniss

[57] ABSTRACT

A power distribution network is disclosed for use in a frequency scan antenna element. A microwave signal applied to the input of the network is power divided and phase shifted so as to provide, at a plurality of output ports, signals of equal amplitude and, at a design frequency, phase equality. The signals appearing at the output ports are phase delayed relative to the signals at adjacent outputs such that an input signal frequency other than the design frequency presents a wave front across the output ports angled away from the normal to the output ports. The present invention discloses a series-parallel configuration of the power distribution network which provides improvements over both the pure-series and the pure-parallel configurations of the prior art.

9 Claims, 8 Drawing Figures

PRIOR ART *Fig. 1.*
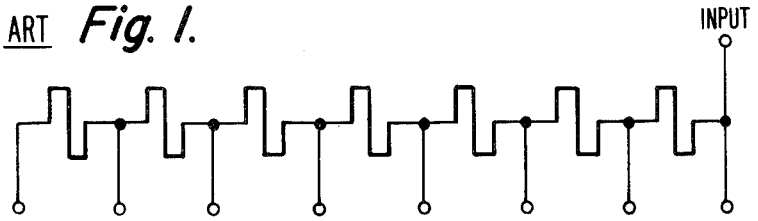
PRIOR ART *Fig. 2.*
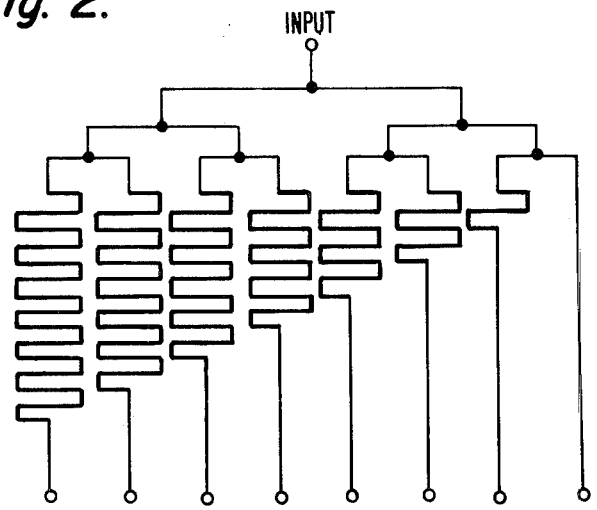
*Fig. 3.*
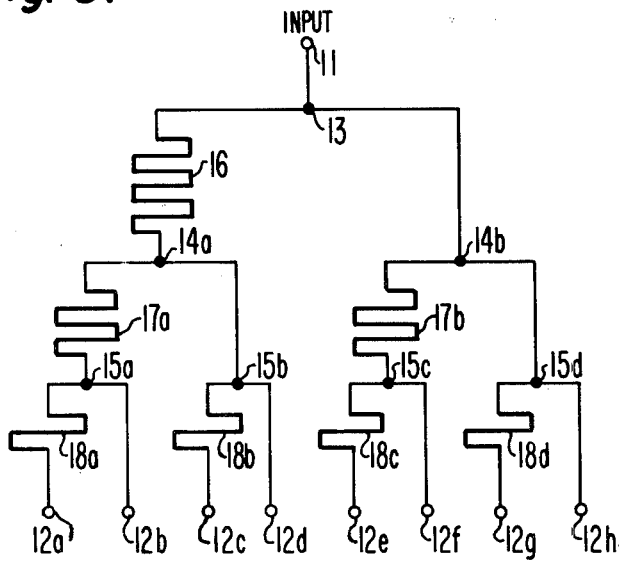

CIRCUIT FOR FREQUENCY SCAN ANTENNA ELEMENT

The Government has rights in this invention pursuant to Contract No. DASG60-77-C-0142 awarded by the Department of the Army.

This invention relates to antenna elements and, more particularly, to an improved circuit for distributing a frequency scanning beam to the radiating elements of each of the subarrays of an antenna array.

The present invention is incorporated within an X-band antenna which performs electronic scanning by combining phase and frequency scanning techniques. The antenna is an array formed of a large number of subarrays. Programmed control of phase shifters, one being associated with each subarray, provides phase scanning of the array factor in two angular coordinates. The subarrays are identical line arrays of radiating elements fed by a serpentine element, a transmission line network that imparts frequency scanning to the beam of the subarray along the direction of the line of radiating elements.

The general arrangement of a phase array of frequency scanned subarrays offers advantages of economy of construction and operation relative to a conventional completely-phase-scanned array. The use of passive frequency scanning networks reduces the number of active phase shifters from that required otherwise, by a significant factor, that factor being equal to the number of radiating elements in each subarray.

The serpentine element, which is the subject of the present disclosure, is an N-way branching network which interfaces with the array beamforming system at its input port and with transmission lines coupled to each radiator at its branched output ports. The serpentine network uses hybrid junctions in order to be non-reactive and to provide isolation between branch ports under matched conditions. Hybrid junctions of the type best adapted for the embodiment of the serpentine network to be described herein are disclosed in applicant's U.S. Pat. No. 4,310,814 "Transmission Line Hybrid Junction," issued on Jan. 12, 1982, and assigned to the same assignee as the present invention.

For the serpentine network to perform its specified function, that of frequency scanning, it must be constructed with line delays associated with each of the branches such that the signals appearing at the output ports in response to a signal of frequency $f_o$, the design frequency, applied to the input port are of equal amplitude and phase. Input signals above and below the design frequency present a wave front across the radiating elements angled away from the perpendicular to the array. Hence, for an input signal having a frequency which, while increasing (or decreasing), passes through the design frequency, the pointing angle of the wave front across the radiating elements scans from one side to the other side of the normal to the subarray.

The line delays associated with the several output ports of the serpentine element are provided by line sections of differing lengths. A first output port is provided with a nominal delay with respect to the input port. A second output port, adjacent to the first, is provided with a delay which is the nominal delay of the first port plus some fixed integral multiple of wavelength of the design frequency $f_o$. The third output port is provided with a delay which is the nominal delay plus twice the fixed multiple of $f_o$ wavelength, the fourth port has the nominal plus three times the fixed multiple of $f_o$ wavelength. In like manner, the $N^{th}$ output port has a delay which is the nominal delay plus $(N-1)$ times the fixed integral multiple of the wavelength of $f_o$. For economy of space and ease of design, the delay lines are provided as convoluted loops of transmission line, giving the appearance of a serpentine path, and hence the name.

There are two basic types of power distribution systems. In one, the series feed, energy applied at the input node is coupled at uniform intervals out of the delay line. In the other, energy is distributed by some means, such as a corporate-feed structure, in parallel to a set of delay lines, each systematically longer than the prior one. Because of its physical simplicity, the series approach is conventionally employed.

Both of these methods of power distribution have inherent shortcomings. In the series circuit, shown in FIG. 1 as prior art, delay lines having an electrical length of an integral number of wavelengths at the design frequency, or k-wavelengths, alternate with hybrid junctions in a cascade string. In order to provide equal amplitude signals, the coupling values of the junction have to be graduated.

The parallel circuit shown in FIG. 2 avoids the large range of coupling values necessitated by the series arrangement. It takes the form of a purely parallel corporate branching circuit combined with delay lines having individual graduated length, from k-wavelength to $(N-1)$ k-wavelength. The hybrid junctions are all uniform symmetrical power dividers when the number of output ports is an integral power of two. As all of the branches of the parallel configuration have separate delay lines, of graduated lengths, the total area in the circuit devoted to delay lines is considerably larger than in the series circuit.

An improved circuit for N-way, phased power division to be disclosed herein is denoted as the series-parallel circuit. It employs a combination of series and parallel paths. This circuit has the same advantages as the parallel circuit in its use of uniform symmetrical power dividing junctions. It uses a total length of delay lines that is considerably less than for the parallel circuit, although greater than for the series circuit. A further advantage in favor of this improved circuit is the relative ease in which a design for N output ports may be converted to a design for N/2 or 2N branches with only minor alternations of circuit and housing layouts.

In accordance with the present invention a power distribution network for microwave signals is disclosed. The network provides, at its output ports, signals having substantially equal amplitude and, at a predetermined frequency, a fixed phase relationship in response to a signal applied to the network input port. The network comprises a first power divider with its main port coupled to the network input port and $m_1$ branch ports providing equal power distribution. Each of the $m_1$ branch ports is coupled to $m_1$ transmission lines which couple, at their other ends, to the main ports of $m_1$ power dividers. Each of the $m_1$ power dividers divides into $m_2$ branches, and provides equal power division therein. Subsequent power divisions continue in like manner to the $n^{th}$ level of power division where $$\prod_{i=1}^{n-1} m_i$$

power dividers, each having $m_n$ branch ports, are coupled to $$\prod_{i=1}^{n} m_i$$

transmission lines which couple, at their other ends, to the output ports of the network. The several transmission lines of the network have electrical lengths at the predetermined frequency which are interrelated at the $j^{th}$ level of power division according to $$\phi, \phi + k \prod_{i=j+1}^{n} m_i, \phi + 2k \prod_{i=j+1}^{n} m_i, \ldots,$$

$$\phi + \left( \prod_{i=1}^{j} m_i - 1 \right) k \prod_{i=j+1}^{n} m_i,$$

where $0 < j \leqq n$, $\phi$ is an arbitrary electrical length at the predetermined frequency, and k is a non-zero constant. The result that at any level of power division the electrical lengths of any pair of transmission lines differ by a constant multiplier of the wavelength of the predetermined frequency, ensures that all of the signals at the output ports will have the fixed phase relationship.

In the drawing:

FIG. 1 is a schematic representation of a series-connected power distribution network according to the prior art;

FIG. 2 is a schematic representation of a parallel-connected power distribution network according to the prior art;

FIG. 3 is a schematic representation of one embodiment of the series-parallel power distribution network of the present invention;

Figure 4:
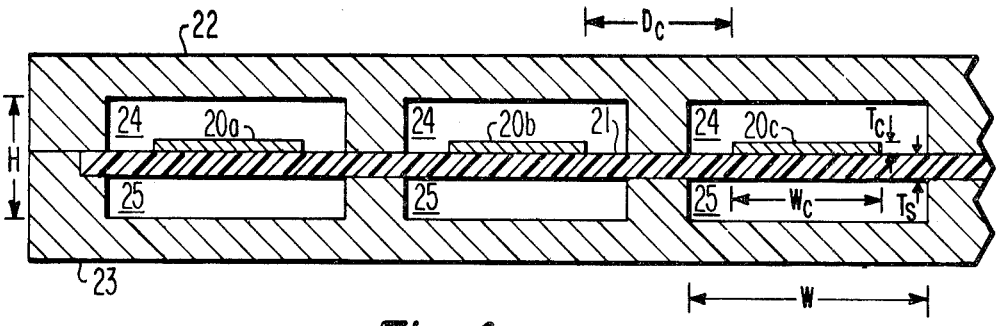
FIG. 4 is a cross-sectional view of a portion of the suspended substrate transmission line of the type employed in the preferred embodiment.

In the series circuit, shown in FIG. 1 as prior art, delay lines having an electrical length of an integral number of wavelengths at the design frequency, or k-wavelengths, alternate with hybrid junctions in a cascade string. The required k-wavelength incremental delay between adjacent output lines is thus achieved and the wave energy between the input port and a remote output port traverses several lengths of line in series. The desired equal amplitude signal at the output ports requires that the coupling values of the junctions be graduated in accordance with 1/n in power ratio, where n is the index of the output port numbered from the end of the serpentine element remote from the input port, the left end in FIG. 1. The coupling values of a 16-element serpentine network, for example, would range from 3 dB to 12 dB. Difficulty is encountered in selecting a type of hybrid junction which possesses high quality performance over this range and which design lends itself well to economic production in the medium selected for this application, that of suspended substrate transmission line. The large number of hybrid junctions traversed by a wave to the n=1 port imparts a bandwidth limitation to that path that is more severe than for a single junction. The graduated coupling coefficients of the couplers are associated with a graduated main line transmission phase characteristic. This must be absorbed by graduated corrective phase changes in the individual k-wavelength transmission lines.

The parallel circuit, shown in FIG. 2 as prior art, is an alternative which avoids the large range of coupling values necessitated by the series arrangement. It takes the form of a purely parallel corporate branching circuit combined with delay lines having individual graduated length, from k-wavelength to (N−1) k-wavelength. The hybrid junctions are all uniform symmetrical power dividers when the number of output ports is an integral power of two. For other numbers of outputs the circuit usually may be arranged so that nearly all of the hybrid junctions are symmetrical and the small number remaining is not markedly unbalanced. The delay for the last output port, the port shown on the extreme left in FIG. 3, is as long as the total of the delay lines in the conventional series form shown in FIG. 1. As all of the branches of the parallel configuration have separate delay lines, of graduated lengths, the total area in the circuit devoted to delay lines is considerably larger than in the series circuit. In this purely parallel circuit, no delay line is used by more than one output signal.

An eight-output serpentine network is shown schematically in FIG. 3. Although shown as single conductors, each of the elements of FIG. 3 represents a transmission line; the second, or ground, conductor is implied but not shown. A serpentine network having power distributed equally from an input port 11 to eight output ports 12*a*, 12*b* . . . 12*h*, and referred to collectively as output ports 12, lends itself to three levels of equal power division as shown in FIG. 3. Points 13, 14*a*, 14*b*, 15*a*, 15*b*, 15*c*, and 15*d* represent hybrid junctions which provide, at their branch ports, equal amplitude, in-phase power division of a signal applied to their common ports. Delay line 16 represents a segment of serpentine transmission line having four units of delay; delay lines 17*a* and 17*b* represent transmission lines each having two units of delay; and delay lines 18*a*, 18*b*, 18*c*, and 18*d* represent transmission lines each having a single unit of delay. Each unit of delay is some fixed integral multiplier of the wavelength of design frequency $f_o$ of the serpentine network.

Considering now the several paths through the serpentine network of FIG. 3, the path to output port 12*a* encounters delay lines 16, 17*a*, and 18*a*, a total of seven delay units; the path to output port 12*b* encounters delay lines 16 and 17*a*, a total of six delay units; the path to output port 12*c* encounters delay lines 16 and 18*b*, a total of five delay units; the path to output port 12*d* encounters only delay line 16, a total of four delay units; the path to output port 12*e* encounters delay lines 17*b* and 18*c*, a total of three delay units; the path to output port 12*f* encounters delay line 17*b*, a total of two delay units; the path to output port 12*g* encounters delay line 18*d*, a total of one delay unit; and the path to output port 12*h* encounters no delay lines.

Thus it can be seen that signals appearing at output ports 12, in response to a signal applied at input port 11, will encounter different delays in the several serpentine delay lines of the network. It is also seen that the output ports 12 which are adjacent have a fixed delay difference; that fixed delay being an integral multiple of the wavelength at frequency $f_o$. Therefore, for a signal of frequency $f_o$ applied at input port 11, the signals at output ports 12 will have phase equality. But for an input signal of frequency slightly greater than $f_o$, the phase of the signal at output port 12*a* will lag the phase of the signal at output port 12*b* by a certain angle, and lag the phase of the signal at each of the other outputs 12*c*, 12*d* . . . , *12h* by linearly progressively greater angles. Similarly, for an input signal of frequency slightly less than $f_o$, the phase of the signal at output port 12*a* will lead the phase of the signal at output port 12*b* by a certain angle, and lead the phase of the signal at each of the other outputs 12*c*, 12*d* . . . , 12*h* by linearly progressively greater angles.

Referring again to FIG. 3, it can be readily seen that for a power division network according to the present invention, using binary power dividers and having $N=8$ outputs, there must be $n=3$, or $n=\log_2 N$, levels of hybrid junctions, transmission line 16 must have 4, or $2^{n-1}$, units of delay, transmission lines 17*a* and 17*b* must each have 2, or $2^{n-2}$, units of delay, and transmission lines 18*a* through 18*d* must each have 1, or $2^{n-n}=2^0$, units of delay. In general, however, power dividers which provide more than two branch ports may be employed. In such a case, the power divider at the first level may have $m_1$ branch ports, the power dividers at the second level may each have $m_2$ branch ports, and the power dividers at the $j^{th}$ level may each have $m_j$ ports. In the generalized case, the transmission lines connected to the first level power divider branch ports would include delays of 0, $m_2m_3 \ldots m_n$, $2m_2m_3 \ldots m_n$, $(m_1-1)m_2m_3 \ldots m_n$ delay units, the transmission lines connected to the second level power dividers' branch ports would include delays of 0, $m_3m_4 \ldots m_n$, $2m_3m_4 \ldots m_n, \ldots, (m_1m_2-1)\, m_3m_4 \ldots m_n$ delay units, and the transmission lines connected to the nth level, the last level, power dividers' branch ports would include delays of 0, k, 2k, 3k, 4k, . . . , and $(m_1 m_2 \ldots m_n-1)k$ delay units. It should be noted that each delay unit is a constant multiplier k of the wavelength of the design frequency $f_o$. A general expression for the relationship of the electrical lengths of the transmission lines connected to the branch ports of the power dividers at the $j^{th}$ level of power division is $$0,\ k \prod_{i=j+1}^{n} m_i,\ 2k \prod_{i=j+1}^{n} m_1, \ldots, \left(\prod_{i=1}^{n} m_i - 1\right) k \prod_{i=j+1}^{n} m_i, \tag{1}$$

where $0<j\leqq n$, k is a non-zero constant, and $$\prod_{i=j+1}^{n} m_i$$

is defined as being equal to one for $j=n$.

In the configuration depicted in FIG. 3, the path from input port 11, through hybrid junctions 13, 14*b* and 15*d*, to output port 12*h* shows no explicit delay lines, although an inherent delay $\phi$ is certain to exist, by the physical limitations of the circuit. The same inherent delay $\phi$, found in the above-defined path is incorporated within each other path to the extent necessary to provide the required phase relationship at each of the output ports 12 when a signal of frequency $f_o$ is applied to the input port 11. The effect of this incorporated delay $\phi$ is to modify expression (1) to read:

$$\phi,\ \phi + k \prod_{i=j+1}^{n} m_i,\ \phi + 2k \prod_{i=j+1}^{n} m_i, \ldots, \phi + \tag{2}$$

-continued $$\left(\prod_{i=1}^{j} m_i - 1\right) k \prod_{i=j+1}^{n} m_i$$

For the case in which all of the power dividers are of the type in which a signal applied to a common port is equally divided into two branch ports, $m_i$ is equal to two for all values of i, and expression (2), as a general expression for the relationship of the electrical lengths of the transmission lines connected to the branch ports of the power dividers at the $j^{th}$ level of power division, becomes:

$$\phi,\ \phi+(k)2^{n-j},\ \phi+(2k)2^{n-j}, \ldots, \phi+(2^j-1)\,(k)2^{n-j} \tag{3}$$

where $0<j\leqq n$ and k is a non-zero constant.

Throughout the foregoing description k has been described as a "constant multiplier" of the wavelength of $f_o$, and not explicitly as an "integral multiple" of the wavelength. While it may appear that for the frequency scanning subarray to provide its proper function it must have output signals with phase equality, thereby necessitating an integral k, the applicant has found that a value of $k=5.5$ provides optimum system performance in the embodiment to be described hereinafter. The applicant accommodates the inverted phase at alternate output ports of the serpentine network by reversing the wire pairs of each transmission line (not shown) connecting alternate output ports with their corresponding radiating elements (not shown).

Table 1 is a numerical comparison of the pure-series and pure-parallel configurations of the prior art and the series-parallel configuration of the present invention for $N=8$ and, in parentheses, for $N=16$.

TABLE 1

COMPARISON OF SERPENTINE ELEMENT CIRCUIT TYPES FOR N = 8 (N = 16)

| | Pure Series | Pure Parallel | Series-Parallel |
|---|---|---|---|
| Number of Hybrids | | | |
| Total | 7 (15) | 7 (15) | 7 (15) |
| Maximum in One Path | 7 (15) | 3 (4) | 3 (4) |
| Number of Delay Lines | | | |
| Total | 7 (15) | 7 (15) | 7 (15) |
| Maximum in One Path | 7 (15) | 1 (1) | 3 (4) |
| Number of Units of Delay | | | |
| Total | 7 (15) | 28 (120) | 12 (32) |
| Maximum in One Delay Line | 1 (1) | 7 (15) | 4 (8) |
| Maximum in One Path | 7 (15) | 7 (15) | 7 (15) |
| Number of Hybrid Phase Compensations Required | 6 (14) | 0 (0) | 0 (0) |
| Number of Different Coupling Coefficients | 7 (15) | 1 (1) | 1 (1) |

The present embodiment is executed in suspended-substrate transmission line, an example of which is depicted in cross-sectional view in FIG. 4. The first conductors 20*a*, 20*b* . . . , referred to collectively as conductors 20, are narrow conducting strips bonded to one side of a dielectric substrate 21. The substrate 21 may be, for example, a Teflon-fiberglass laminate having a permittivity of $\epsilon=3.15$. The second conductor, or ground plane, comprises two conductive blocks 22 and 23 which, in the present embodiment, are made of aluminum. Conductive blocks 22 and 23 support substrate 21 and maintain the position of the narrow strip conductors 20 within channels 24 and 25 in the conductive blocks 22 and 23, respectively. Air forms the balance of the dielectric material within channels 24 and 25. The permittivity of air is $\epsilon=1.0$.

In this embodiment the characteristic impedance of each section of the transmission line is determined, for the most part, by the field interaction of the narrow strip conductors 20 with the upper and lower surfaces of the ground conductors 22 and 23. The effect on the characteristic impedance of the interaction between the narrow strip conductors 20 and the side walls of the channels 24 and 25 within conductive blocks 22 and 23 is small but measurable, and must be considered when the transmission lines are implemented.

The applicant has chosen suspended-substrate for his embodiment, but the principles to be taught herein are equally applicable to other types of transmission line. Among the other types are coaxial cable, in which concentric cylindrical conductors are spaced by a dielectric material; microstrip, in which two strip conductors are bonded to opposite sides of a dielectric substrate; strip transmission line, in which the first conductor is sandwiched between strips of the ground conductor but spaced from them by layers of dielectric material; and suspended strip, in which the first conductor is a narrow strip conductor suspended within a second conductor, with air as the only dielectric material. Any arrangement of transmission line conductors capable of transmitting energy in the transverse electromagnetic (TEM) mode may be applied to this invention.

Figure 5:
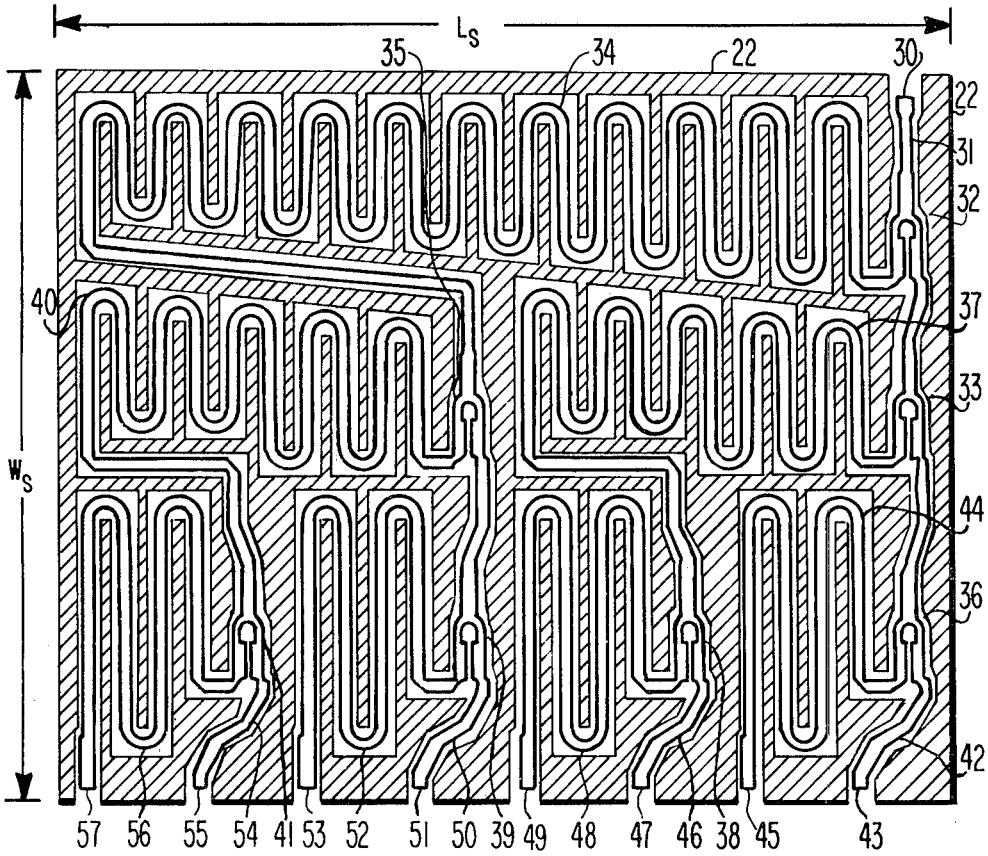
FIG. 5 is a plan view of the preferred embodiment of the instant invention with the horizontal plate of the upper ground plane removed.

FIG. 5 is a plan view of the layout of the narrow strip conductors of a suspended-substrate transmission line version of the serpentine network according to the preferred embodiment of the instant invention, showing the general relationship of the component parts. The view of FIG. 5 is that which would be obtained by looking down on FIG. 4 with the top plate of conductive block 22 removed. The serpentine network of this example includes seven hybrid junctions and seven convoluted conductive strips of varying length. Although shown as single conductors, the conductive strips and hybrid junctions form, with the ground conductors 22, transmission lines, each having, in this example, a characteristic impedance level of 70 ohms. The lengths of the several strips of transmission line are measured in wavelengths of the design frequency $f_o$ which, in this case, is 10 GHz.

The input port 30 is shown as a tab of the conductive strip 31 for connection to any suitable microwave connector. The conductive strip 31, including a quarter-wavelength transforming section, connects input port 30 to the common port of hybrid junction 32. One of the branch ports of hybrid junction 32 connects via a conductive strip to the common port of hybrid junction 33; the other branch port connects to a 22-wavelength delay line 34, the other end of which connects to the common port of hybrid junction 35. One of the branch ports of hybrid junction 33 connects via a conductive strip to the common port of hybrid junction 36; the other branch port connects to an 11-wavelength delay line 37, the other end of which connects to the common port of hybrid junction 38. One of the branch ports of hybrid junction 35 connects via a conductive strip to the common port of hybrid junction 39; the other branch port connects to a second 11-wavelength delay line 40, the other end of which connects to the common port of hybrid junction 41. One of the branch ports of hybrid junction 36 connects via conductive strip 42 to output port 43; the other branch port connects to a 5.5-wavelength delay line 44, the other end of which connects to output port 45. One of the branch ports of hybrid junction 38 connects via conductive strip 46 to output port 47; the other branch port connects to a second 5.5-wavelength delay line 48, the other end of which connects to output port 49. One of the branch ports of hybrid junction 39 connects via conductive strip 50 to output port 51; the other branch port connects to a third 5.5-wavelength delay line 52, the other end of which connects to output port 53. One of the branch ports of hybrid junction 41 connects via conductive strip 54 to output port 55; the other branch port connects to a fourth 5.5-wavelength delay line 56, the other end of which connects to output port 57.

Each of the conductive strips connected to the eight output ports 43, 45, 47, 49, 51, 53, 55, and 57 includes a quarter-wavelength transforming section, as does the conductive strip 31 connecting to the input port 30. The transforming sections bridge the transitions between the 70-ohm characteristic impedance level of the serpentine network and the 50-ohm level of the outside world, in this particular example.

Applicant has constructed and tested one embodiment of the present invention, specifically the embodiment depicted in FIGS. 4 and 5 and described herein. The dimensions listed below correspond approximately to applicant's serpentine network, although fine-tuning of the dimensions must occur after exhaustive testing in the proper environment.

The length of the serpentine network module, $L_S=15.6$ cm;

the width of the serpentine network module, $W_S=12.9$ cm;

the distance between adjacent conductors, $D_C=4.7$ mm;

the width of the conductors, $W_C=1.7$ mm;

the thickness of the conductors, $T_C=0.0025$ to 0.005 mm;

the thickness of the substrate, $T_S=0.2$ mm;

the width of the channels in the conductive blocks, $W=5.1$ mm; and the overall height of the channels, $H=2.5$ mm.

The particular embodiment of the present invention thus far disclosed has taught phase-related, equal-amplitude power division for the case where the number of output ports is an integral power of two. The example showed eight outputs, but it is easily seen where sixteen outputs could be implemented in the same manner. Where the number of output ports is not equal to a power of two, other means must be applied to make the series-parallel configuration of the present invention effective.

Figure 6:
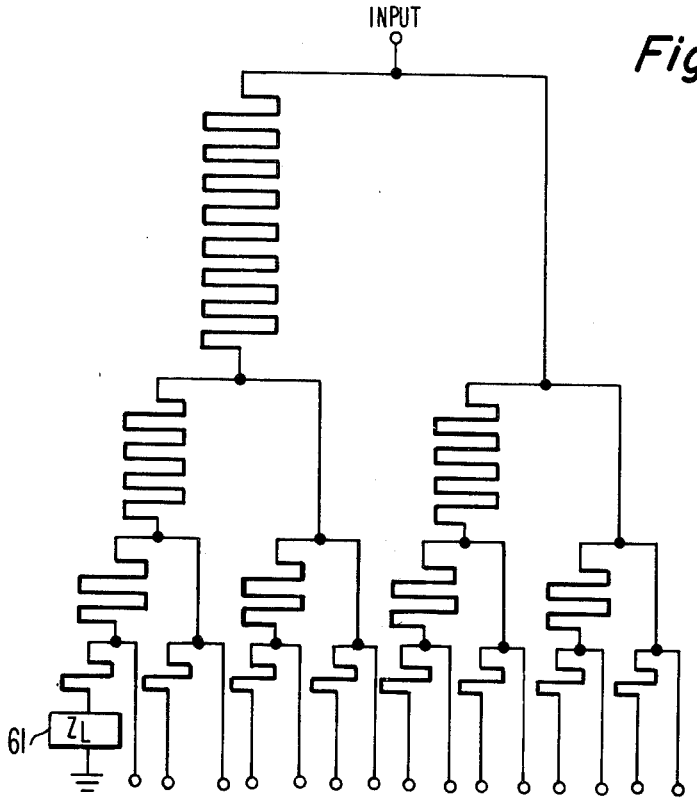
FIGS. 6, 7 and 8 are schematic representations of three variations of the basic embodiment depicted in FIG. 3.

For the case where fifteen output ports are required probably the most effective method is to provide a serpentine network having four levels of binary power division, resulting in sixteen output ports, and disregard the signal appearing at the last port. This method, shown schematically in FIG. 6, would result in a small power loss into the dummy load impedance 61, one-sixteenth of the power provided, but the simplicity of the serpentine network might prove to be a more significant factor than the small loss of power.

Figure 7:
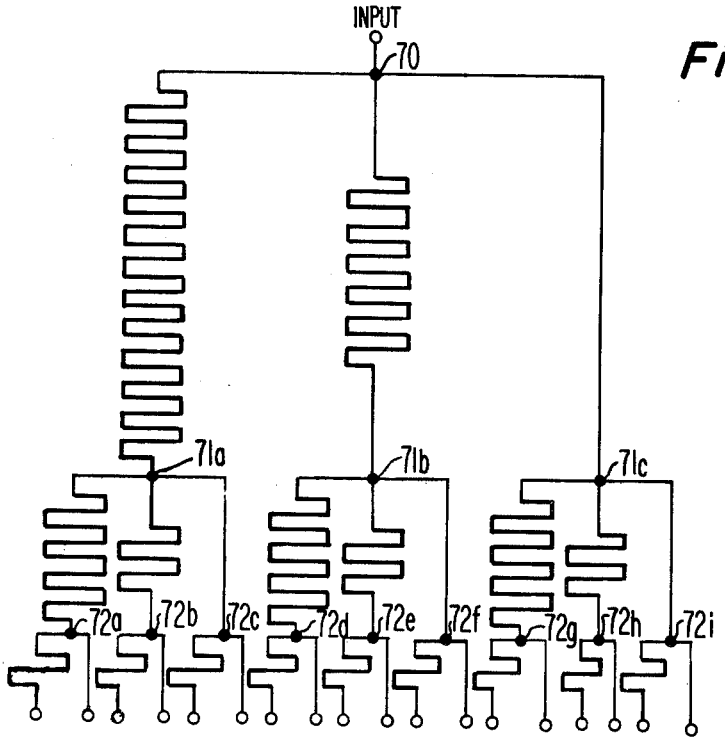

For the case where eighteen output ports are required, one efficient method of implementing the serpentine network might include power dividers having more than two branch ports. Wilkinson, in U.S. Pat. No. 3,091,743, issued May 28, 1963, taught the use of N-port power dividers, and Galani et al., in U.S. Pat. No. 4,129,839, issued Dec. 12, 1978, extended the Wilkinson N-way divider to a planar surface. Thus, it can be seen, in the schematic representation of FIG. 7, that for a first level of power division of three, hybrid junction 70, a second level of power division of three, hybrid junctions 71*a*, 71*b* and 71*c*, and a third level of power division of two, hybrid junctions 72*a*, 72*b* , . . . , 72*i*, eighteen outputs can be provided by the serpentine network, the signal at each output having equal-amplitude and phase equality at a design frequency.

Figure 8:
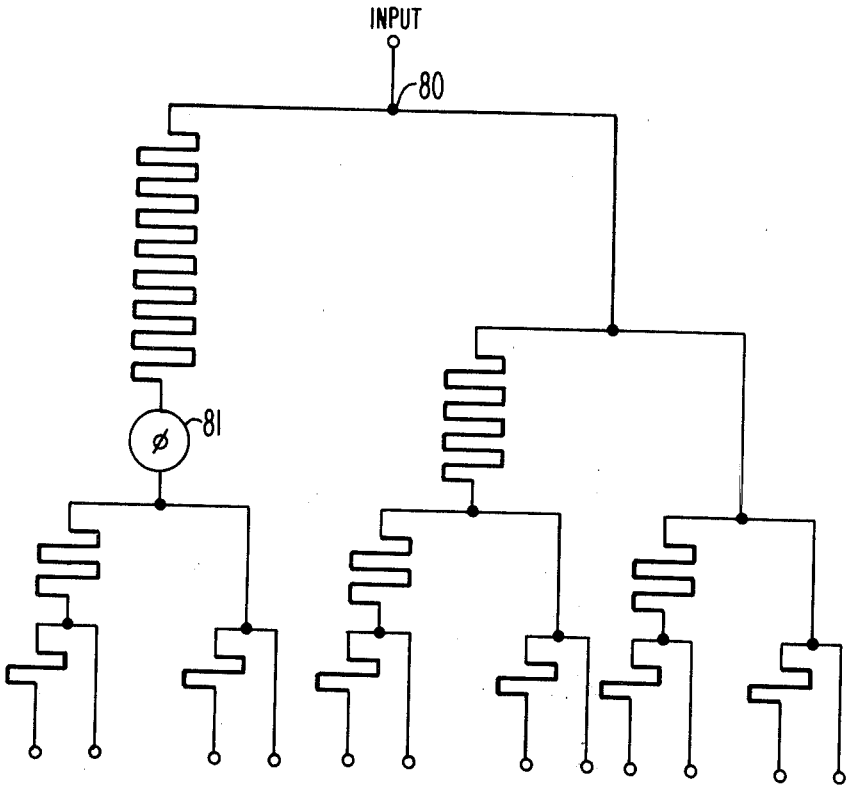

A third method of providing a number of serpentine network outputs, not a power of two, is to employ unequal power dividers. Although the disclosure has heretofore described a serpentine network in which the signals at the output ports are equal, that should not be construed as a limitation on the invention. FIG. 8 depicts in schematic form a 12-output serpentine network, according to the present invention, in which the first level of power division, at power divider 80, is unequal; half as much power is provided to the left-hand branch as to the right-hand branch. Unequal power dividers were taught by Schwarzmann in U.S. Pat. No. 3,742,392, issued June 26, 1973. One concomitant of this method is the need for a phase shifter 81, to account for the unequal number of levels of power division at the two branches of power divider 80.

Although the description of the invention has dealt with a serpentine network in which the signal applied to a common port is distributed to a plurality of branch ports, this particular direction of signal flow should not be considered as limiting the disclosure. It would be obvious to one skilled in the art to use the same structure as a power combiner, in which a plurality of signals is applied respectively to the branch ports with the resulting signal appearing at the common port.

What is claimed is:

1. A power distribution network for use in a frequency scanning antenna system responsive to signals applied to an input port for providing at a plurality of output ports output signals of substantially even power distribution and, at a predetermined frequency, a fixed phase relationship, said network comprising:

a first power divider comprising a common port coupled to said input port and having $m_1$ branch ports for dividing power applied to said common port equally into said $m_1$ branch ports;

$m_1$ transmission lines with each of said $m_1$ lines coupled at a first end to a corresponding one of said $m_1$ branch ports of said first power divider and having second ends;

$m_1$ power dividers, each comprising a common port coupled to a corresponding one of the second ends of said $m_1$ transmission lines, and having $m_2$ branch ports for equally dividing power applied to the common ports of said $m_1$ power dividers;

means including power dividers and transmission lines coupled in like manner at successive levels of power division for providing, at the $n^{th}$ level of power division, $$\prod_{i=1}^{n-1} m_i$$

power dividers having $$\prod_{i=1}^{n} m_i$$

branch ports and $$\prod_{i=1}^{n} m_i$$

transmission lines each having first ends coupled to a corresponding one of the $$\prod_{i=1}^{n} m_i$$

branch ports of said $$\prod_{i=1}^{n-1} m_i$$

power dividers and having second ends coupled respectively to said plurality of output ports, wherein said transmission lines coupled to the branch ports of said power dividers have electrical lengths at said predetermined frequency which are interrelated at the $j^{th}$ level of power division according to $$\phi, \phi + k \prod_{i=j+1}^{n} m_i, \phi + 2k \prod_{i=j+1}^{n} m_i, \ldots, \phi + \left(\prod_{i=1}^{j} m_i - 1\right) k \prod_{i=j+1}^{n} m_i,$$

where $0<j\leqq n$, $\phi$ is an arbitrary electrical length at said predetermined frequency, and k is a non-zero constant, such that the electrical lengths of any pair of said $$\prod_{i=1}^{n} m_i$$

transmission lines differ by a multiple of the wavelength at said predetermined frequency, thereby providing said fixed phase relationship of the signals of said predetermined frequency at all of said output ports and predetermined phase differentials at other frequencies.

2. The power distribution network according to claim 1 wherein the electrical lengths of any pair of said $$\prod_{i=1}^{n} m_i$$

transmission lines differ by an integral multiple of the wavelength at said predetermined frequency, thereby providing phase equality of the signals of said predetermined frequency at all of said output ports.

3. A power distribution network for use in a frequency scanning antenna system responsive to signals applied to an input port for providing at $N=2^n$ output ports signals of substantially even power distribution, and for providing signals at said N output ports having phase equality at a predetermined frequency and predetermined phase differentials at other frequencies, said network comprising:

$2^n-1$ power dividers arranged in a multi-tiered structure, where each tier comprises one or more power dividers coupled to the power dividers of the previous tier, each of said power dividers having a common port and two branch ports, said power divider at a first tier being coupled to said input port of said network at its common port, and $2^{n-1}$ power dividers at a final tier having their N branch ports coupled respectively to said output ports;

means coupled to the branch ports of said power divider at the first tier for phase shifting the signal at one branch port by $(2^{n-1})k$ wavelengths at said predetermined frequency in excess of the phase shift of the other branch port, means coupled to the branch ports of the power dividers at the second tier for phase shifting the signal at one branch port of each of the two power dividers at the second tier by $(2^{n-2})k$ wavelengths at said predetermined frequency in excess of the phase shift of the other branch port, and means coupled to the branch ports of the power dividers at the $j^{th}$ tier for phase shifting the signal at one branch port of each of the $2^{j-1}$ power dividers at the $j^{th}$ tier by $(2^{n-j})k$ wavelengths at said predetermined frequency in excess of the phase shift of the other branch port, where k is a non-zero integral constant.

4. A power distribution network for use in a frequency scanning antenna system responsive to signals applied to an input port for providing at $N=2^n$ output ports signals of substantially even power distribution, and for providing signals at said N output ports having phase equality at a predetermined frequency and predetermined phase differentials at other frequencies, said network comprising:

$2^n-1$ power dividers arranged in a multi-tiered structure, where each tier comprises one or more power dividers coupled to the power dividers of the previous tier, each of said power dividers having a common port and two branch ports, said power divider at a first tier being coupled to said input port of said network at its common port, and $2^{n-1}$ power dividers at a final tier having their N branch ports coupled respectively to said output ports;

means coupled to the branch ports of said power divider at the first tier for phase shifting the signal at one branch port by $(2^{n-1})k$ wavelengths at said predetermined frequency in excess of the phase shift of the other branch port, and means coupled to the branch ports of the power dividers at the $j^{th}$ tier for phase shifting the signal at one branch port of each of the $2^{j-1}$ power dividers at the $j^{th}$ tier by $(2^{n-j})k$ wavelengths at said predetermined frequency in excess of the phase shift of the other branch port, where k is a non-zero integral constant.

5. The power distribution network according to claims 1, 2, 3 or 4, wherein all of said power dividers are hybrid junctions each comprising a first transmission line coupled to a pair of branch transmission lines.

6. The power distribution network according to claims 1, 2, 3 or 4, wherein all of said power dividers and said transmission lines transmit energy in the transverse electromagnetic (TEM) mode.

7. The power distribution network according to claims 1, 2, 3 or 4, wherein all of said power dividers and said transmission lines are of the type including a first conductor enclosed within and spaced from a second conductor.

8. The power distribution network according to claim 7, wherein said first conductor is a narrow strip-like conductor suspended within said second conductor.

9. The power distribution network according to claim 8, wherein said narrow strip-like conductor is bonded to a dielectric substrate.

* * * * *